US012083582B2

(12) United States Patent
Brahmer

(10) Patent No.: US 12,083,582 B2
(45) Date of Patent: Sep. 10, 2024

(54) HOLD-DOWN DEVICE FOR A PROCESS DURING STAMPING AND/OR RIVETING

(71) Applicant: Voith Patent GmbH, Heidenheim (DE)

(72) Inventor: Bert Brahmer, Bruchsal (DE)

(73) Assignee: Voith Patent GmbH, Heidenheim (DE)

( * ) Notice: Subject to any disclaimer, the term of this patent is extended or adjusted under 35 U.S.C. 154(b) by 0 days.

(21) Appl. No.: 17/651,777

(22) Filed: Feb. 18, 2022

(65) Prior Publication Data

US 2022/0168801 A1 Jun. 2, 2022

Related U.S. Application Data

(63) Continuation of application No. PCT/EP2020/073082, filed on Aug. 18, 2020.

(30) Foreign Application Priority Data

Aug. 20, 2019 (DE) ..... 10 2019 122 276.1

(51) Int. Cl.
*B21J 15/28* (2006.01)
*B21J 15/02* (2006.01)
*B21J 15/20* (2006.01)

(52) U.S. Cl.
CPC ..... *B21J 15/28* (2013.01); *B21J 15/025* (2013.01); *B21J 15/20* (2013.01)

(58) Field of Classification Search
CPC . B21D 28/343; B21J 9/04; B21J 15/10; B21J 15/20; B21J 15/28
See application file for complete search history.

(56) References Cited

U.S. PATENT DOCUMENTS 3,747,194 A 7/1973 Christensen
4,096,727 A 6/1978 Gargaillo
(Continued)

FOREIGN PATENT DOCUMENTS

DE 201 06 207 U1 7/2001
DE 10 2009 034 542 A1 1/2010
(Continued)

OTHER PUBLICATIONS

Notification of the Transmission of the International Search Report and Written Opinion of the International Search Authority or Declaration dated Nov. 20, 2020 for International Application No. PCT/EP2020/073082 (15 pages).
(Continued)

*Primary Examiner* — Christopher J. Besler
(74) *Attorney, Agent, or Firm* — Taylor IP, P.C.

(57) ABSTRACT

The invention relates to a hold-down device for a joining drive and joining drive with a hold-down device. The hold-down device includes a hold-down cylinder, wherein the hold-down cylinder provides a hold-down force by means of a pressurized chamber. The pressure chamber consists of the hold-down cylinder and a punch of the joining drive. The pressurization required for the provision of the hold-down force is provided by a hydraulic circuit of the joining drive. In the joining mode, the pressure chamber of the hold-down device is connected to a pressure accumulator of the hold-down device, so that a change in volume in the pressure chamber of the hold-down device has no noticeable influence on the pressure in the pressure chamber.

8 Claims, 2 Drawing Sheets

(56) References Cited

U.S. PATENT DOCUMENTS

| | | | | |
|---|---|---|---|---|
| 9,689,407 | B2 * | 6/2017 | Junginger | F15B 11/17 |
| 2012/0260647 | A1 * | 10/2012 | Draht | B21J 15/025 60/484 |
| 2016/0084280 | A1 * | 3/2016 | Maier | F15B 11/022 60/431 |
| 2018/0272419 | A1 | 9/2018 | Draht et al. | |

FOREIGN PATENT DOCUMENTS

| | | | |
|---|---|---|---|
| DE | 10 2009 040 126 | A1 | 3/2011 |
| DE | 10 2011 002 058 | A1 | 10/2012 |
| DE | 10 2015 213 433 | A1 | 1/2017 |
| DE | 10 2018 200 012 | A1 | 7/2019 |
| WO | 99/26743 | A2 | 6/1999 |
| WO | 02/00368 | A2 | 1/2002 |

OTHER PUBLICATIONS

German Office Action dated Mar. 27, 2020 for German Application No. 10 2019 122 276.1 (12 pages).

* cited by examiner

HOLD-DOWN DEVICE FOR A PROCESS DURING STAMPING AND/OR RIVETING

CROSS REFERENCE TO RELATED APPLICATIONS

This is a continuation of PCT application No. PCT/EP2020/073082, entitled "HOLD-DOWN DEVICE FOR A PROCESS DURING STAMPING AND/OR RIVETING", filed Aug. 18, 2020, which is incorporated herein by reference.

BACKGROUND OF THE INVENTION

1. Field of the Invention

The present invention relates to a riveting process or riveting, described as a manufacturing process in the category of "joining through deformation" which includes the production of a rivet connection. During riveting the auxiliary joining component—the rivet—undergoes a deformation at the connecting hole. Riveting is a joining process, in particular for sheet metals and similar minimum strength semi-finished products.

2. Description of the Related Art

The aim of punch riveting is the indirect non-detachable joining of sheet metal components without having to pre-punch, as is necessary in customary solid riveting and blind riveting. For this purpose, a rivet element (auxiliary joining component) is used, which simultaneously acts as a punch. Depending on the rivet element used, two punch riveting processes are of principle importance: punch riveting with full rivets or punch riveting with semi-tubular rivets. Both methods have in common that they require two-sided accessibility to the components, and that the connection is produced in a one-step positioning process.

To achieve a desired joining quality it is necessary to press together the two metal sheets with a certain force, prior to the start of the joining process. This prevents for example, lateral movement of the metal sheets due to transverse forces. The aforementioned force is applied by a hold-down device. This hold-down device applies force before the rivet is driven into the metal sheets with the joining force.

Punch riveting devices and methods are known for example from German documentation DE 10 2018 200 012 A1 and DE 10 2015 213 433. The punch riveting device includes a punch, and a die assigned to the punch. The die and the punch are arranged on opposite sides of the components to be joined.

A riveting device and a method for riveting is known from EP 1 294 505 B1, wherein the hold down device and the punch for riveting are pressurized via a common pressure chamber. The forces acting upon the rivet and the hold-down device, and their ratio are adjusted based on the surface conditions. The disadvantage is, that these two forces acting upon the workpiece are always established by the surfaces of the punch piston and the hold-down piston that are pressurized by means of the pressure chamber.

A method and a device for producing a punch rivet connection are known from EP 1 034 055 B1. It is therein provided that, depending on the force of the punch and/or the path of the punch the hold-down device is coupled with, or decoupled from the punch. Coupling of the piston of the hold-down device with the piston of the punch is achieved by a fluid chamber, wherein the fluid in the fluid chamber is incompressible and the pressure in the chamber is changeable. The piston of the punch and the piston of the hold-down device are arranged in a common housing. The punch piston is designed as a synchronizing cylinder and can be moved axially by pressurizing the individual chambers. All hydraulic chambers are arranged in a common housing.

A drive device for a press-in tool with a hold-down device is known from DE 201 06 207 U1. The punch is driven by means of a spindle drive. The hold-down device is operatively connected with the punch by means of a barometric pressure chamber and is moved along by the motion of the punch until meeting with resistance. After impact, only the punch is moved axially by the spindle drive. The pressure chamber of the hold-down device has thereby the effect of a spring. The pressure chamber is connected to a pressure control device via a flow connection. The pressure control device has a pressure regulator, a check valve, a directional valve, and a pressure booster. This pressure control device allows the pressure in the pressure chamber of the hold-down device to be controlled during every riveting process.

A hydraulically operated setting tool with a hydraulic unit, as well as a joining process are known from DE 10 2011 002 058 A. Short cycle times can be achieved through a targeted use of volume flows of hydraulic fluid in a pre-stroke chamber and a return stroke chamber of a piston in conjunction with a punch and a hold-down chamber in conjunction with a plunger and the hold-down device. For this purpose, a tank hose and a pump hose made of a flexible material are provided. Valves are arranged throughout the hoses. By switching the valves, pressurized hydraulic medium can be contained and released. As a result, the hose sections can be used as energy storage for a pressurized volume of hydraulic fluid to shorten cycle times.

An electromotive hydraulic drive for a setting tool with a hold-down device is known from DE 10 2009 040 126 A1. The hydraulic drive has three hydraulic connections. By means of a spindle drive, the piston rod with piston can be moved axially into a hydraulic cylinder. As a result, hydraulic volumes can be provided at different pressures. By switching the provided valves, the chambers of the setting tool can be pressurized with different pressures. The hydraulic drive is designed together with the setting tool as a hydraulically self-contained system. In order for the hydraulic drive to be able to take up sufficient hydraulics for the operation of the setting tool as well as the hydraulics delivered by the setting tool, two hydraulic pressure volume accumulators are provided.

This storage option or respectively, the stored hydraulic volume is accessed during each setting process. The hold-down piston of the setting tool is within a coaxially aligned auxiliary cylinder, and a primary piston is arranged within a coaxially aligned master cylinder.

Another well-known joining technique is clinching. Another synonym is: press joining. This joining technique represents a process for joining sheet metal without the use of an additional material such as a rivet. Wikipedia shows that the static strengths are in the range of about ⅔ to 1.5 times a comparable spot welded joint. The fatigue strength is higher than with spot welded joints due to the lack of notch effect (in the case of non-notching joints) and the absence of a heat-affected zone. Especially when different sheet thicknesses have to be joined, clinching offers great potential. If the "thick in thin" solution is adhered to, static strengths exceeding one and a half times the strength of a spot-welded joint are possible. Another advantage is that different materials and/or coated metal sheets can also be joined.

A clinching joining tool consists of a punch and a die. The metal sheets to be joined are pressed into the die by the punch, under plastic deformation, similar to deep drawing. A special design of the die creates a push-button-like shape that connects the metal sheets with each other in a form- and force-locking manner. Depending on the system, either a depression in the bottom of a rigid die or the yielding of movable die segments causes the metal sheets to form an overlap. In clinching, a hold-down device performs the same function as in riveting or punch riveting.

What is needed in the art is a compact hold-down device in which pressure fluctuations during the joining process are reduced and the design of which is simple.

SUMMARY OF THE INVENTION

The present invention provides a simple method for regulating or adjusting a hold-down force to a predetermined value. An advantageous development of the invention is based on the objective to provide a hold-down device, in which the one hold-down force can be adjusted to a predetermined value.

The present invention has a hold-down device for a joining drive. A hold-down cylinder is provided, whose exerted force is adjusted by pressurization of a pressure chamber. The pressure chamber is hydraulically connected to a pressure accumulator. Advantageously, no valve is required between the pressure chamber and the pressure accumulator. With the adjustment of the pressure in the pressure accumulator, adjustment of the pressure in the pressure chamber occurs simultaneously. The pressure accumulator provides a volume with constant pressure, so that the set pressure is reliably applied. The volume changes in the pressure chamber during the hold-down process result in slight pressure fluctuations, which have no effect on the joining process. As a result, greater short-term pressure fluctuations during a joining process are reduced.

A position sensor is provided for detecting the position of the punch. The punch is surrounded coaxially by a hold-down device. The hold-down device is connected via a spring element with a clamping ring. As a result, the force of the drive is transmitted via the clamping ring to the punch. Moreover, a contact pressure is transferred to the two components to be joined from the drive, via the clamping ring, and the spring element onto the hold-down device. The hold-down force is adjustable, completely independently of the joining force of the joining device.

In one embodiment of the present invention, it is provided that the pressure accumulator has a supply line with a valve. This supply line is intended for a connection with a hydraulic unit of an assigned joining drive. This makes it possible to provide the means of pressure supply through the hydraulic unit of the joining drive for an adjustment of the pressure in the pressure accumulator of the hold-down device. Thus, the hold-down device does not require its own means of pressure supply. On the one hand, the hold-down force of the hold-down device is adjustable, however the hold-down device is cost-effective since a means of pressure supply of a joining drive can be used. Furthermore, it is also advantageous for the required installation space.

In one embodiment of the present invention, at least one position sensor is provided for detecting the relative position of the hold-down cylinder in relation to the punch and/or a pressure sensor for detecting the pressure in the pressure accumulator/pressure chamber of the hold-down device and/or a temperature sensor for detecting the temperature of the hydraulic medium of the hold-down device. Depending on the recorded signals and by a comparison with predetermined signal values, an exact control of the hold-down device is possible.

One embodiment of the present invention provides integration of a hold-down device with a hold-down cylinder and a punch into one unit. A particularly compact design is achieved by radially arranging a pressure chamber between the hold-down cylinder and the punch. In particular, it has proven to be advantageous to arrange the pressure chamber coaxially relative to the punch. This makes an especially compact design possible.

One preferred embodiment suggests mounting the hold-down cylinder axially movably on the punch. By pressurizing the pressure chamber, the hold-down device performs a relative movement to the punch. Moreover, a force deviating from the punch can be exerted onto a component, also referred to as a workpiece, by the hold-down device.

It has proven to be advantageous to provide a pressure accumulator. The pressure chamber is connected to the pressure accumulator during the joining operation. As a result, pressure fluctuations can also be reduced in the event of volume changes in the pressure chamber.

One preferred embodiment provides that the punch is designed with at least one radially protruding flange for the formation of a stop. The stop predetermines a limitation of the relative position of the hold-down device and punch. By providing this stop directly on the punch, a particularly compact hold-down unit is provided.

In one embodiment of the present invention, it is provided that the hold-down device has at least one cover, preferably two covers wherein the cover/the covers is/are detachably connected with the hold-down cylinder. This makes it possible to mount the hold-down device and punch. Also, replacement of the punch can be accomplished in a simple manner.

In an alternative embodiment of the present invention, the hold-down cylinder is mounted on a piston rod of the joining drive instead of on the punch. By providing a hold-down device that can be connected with the hold-down cylinder, the hold-down force can be transferred to a workpiece. Instead of the punch, the cylinder of the joining drive can then be designed with a flange to provide an axial stop.

An embodiment of the present invention provides for using a joining drive with a piston rod, wherein the piston rod is driven by a hydraulic drive. Preferably, a differential cylinder is provided, wherein the piston chamber provides the force required for the joining process. Lesser force is required in the opposite direction, because in the opposite direction the punch is merely to be withdrawn from the tool and to be brought into the starting position.

One embodiment of the present invention provides that the piston chamber is connectable via a valve with the hydraulic circuit. Thus, it is possible in particular, to use the hydraulic unit for pressurization of the accumulator independently of a pressurization of the piston chamber. In particular, it is possible to pressurize the accumulator with hydraulic medium, whereby neither the annular chamber nor the piston chamber are exposed to hydraulic medium. As a result, the hydraulic unit can be used advantageously to set a desired pressure in the accumulator, regardless of pressurization of the joining drive.

One embodiment of the present invention provides, that the accumulator of the hold-down device can be hydraulically connected with the joining drive via at least one switchable valve. Preferably, the accumulator is connected via a first valve with the supply line to the line between the piston chamber and the hydraulic unit and via a second valve with the supply line to the annular chamber. As a result, the pressure accumulator can be supplied with hydraulic medium from the hydraulic unit both via the supply line to the annular chamber and via the supply line to the piston chamber.

One embodiment of the present invention provides, that the hydraulic unit includes a pump with reversible delivery direction, preferably a 4-quadrant pump. As a result, a valve is not required in the feed to the annular chamber It has proven to be advantageous to dimension the hold-down force to 5 to 20% of the maximum joining force that occurs. A corresponding design can be achieved by dimensioning the surface of the pressure chamber that faces in the direction of the component to be joined.

BRIEF DESCRIPTION OF THE DRAWINGS

The above-mentioned and other features and advantages of this invention, and the manner of attaining them, will become more apparent and the invention will be better understood by reference to the following description of embodiments of the invention taken in conjunction with the accompanying drawings, wherein.

Figure 1:
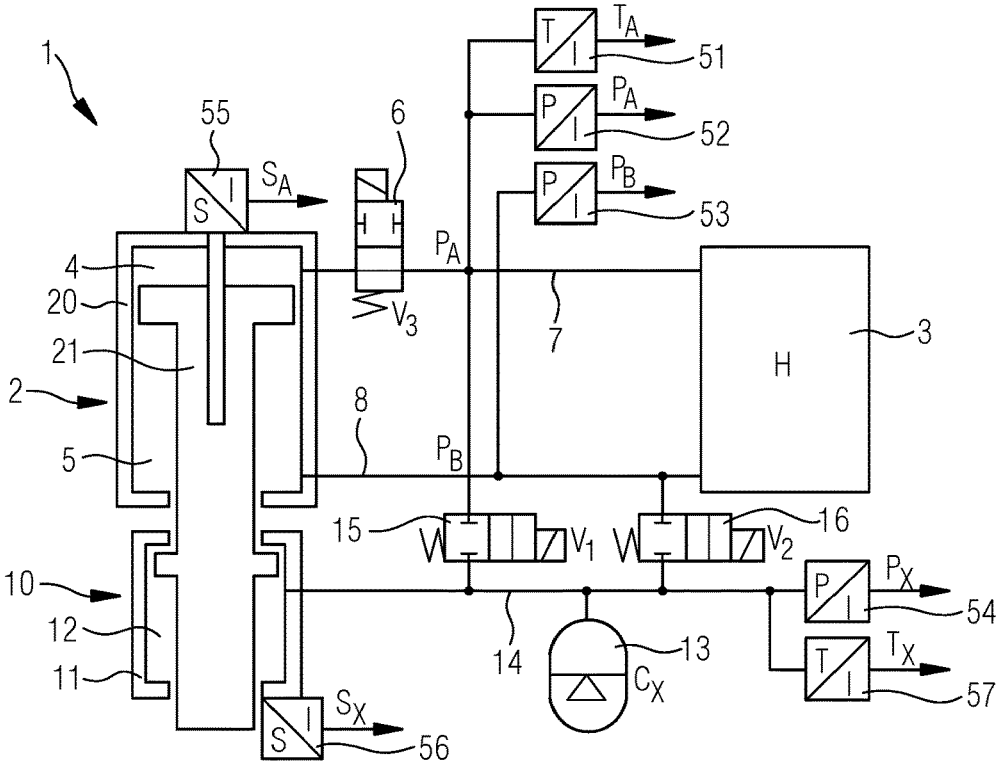
FIG. 1 illustrates an embodiment of a joining drive with controllable and/or adjustable hold-down device of the present invention.

Further advantageous forms of the invention are explained on the basis of design examples, with reference to the drawings. The features mentioned cannot only be advantageously implemented in the combination shown, but can also be combined individually with each other.

Corresponding reference characters indicate corresponding parts throughout the several views. The exemplifications set out herein illustrate embodiments of the invention and such exemplifications are not to be construed as limiting the scope of the invention in any manner.

DETAILED DESCRIPTION OF THE INVENTION

Referring now to the drawings, and more particularly to FIG. 1 which illustrates a joining device 1 with a joining drive 2 with a hold-down device 10. Joining drive 2 has a differential piston with a piston chamber 4 and an annular chamber 5. Piston chamber 4 is connected with a hydraulic unit 3 via a supply line 7. A valve 6 is provided in supply line 7. In the embodiment shown, a directional valve $V_3$ is provided as valve 6, through which a connection of hydraulic unit 3 and piston chamber 4 can be established and separated.

Annular chamber 5 is connected to the hydraulic unit via a supply line 8. No valve is provided in this supply line 8. A position sensor 55 is provided for detecting the position of the piston. Pressure $P_A$ provided by the hydraulic circuit is detected by pressure sensor 52. Temperature $T_A$ of the hydraulic medium is recorded by a temperature sensor 51. Pressure sensor 53 is intended for detection of pressure $P_B$ in supply line 8 to annular chamber 5. Between valve 6 and the hydraulic unit, a hydraulic branch is provided to an accumulator 13 of hold-down device 10. In this supply line another valve, here directional valve 15, is arranged. Through this valve 15, the supply line can be switched from hydraulic unit 3 to accumulator 13 or pressure chamber 12 of hold-down device 10. Pressure $P_X$ in pressure chamber 12 of hold-down device 10 is detected by a pressure sensor 54. Temperature $T_X$ of the hydraulic medium can be detected by a provided temperature sensor 57. The position of the hold-down device or respectively hold-down cylinder 11 relative to punch 22 can be detected by looking at a position sensor 56. Accumulator 13 is connected to pressure chamber 12. By means of accumulator 13, it can be achieved that an almost constant pressure is applied in the pressure chamber regardless of the position of hold-down cylinder 11.

Hold-down force $F_X$ is generated by the hydraulic cylinder, also known as hold-down cylinder 11. The pressure for hold-down force $P_X$ is maintained in a pressure accumulator 13. The adjustability of the force is achieved by changing accumulator pressure $P_X$. To adjust accumulator pressure $P_X$, operating pressure $P_A$, $P_B$ present on hydraulic actuator 20 is used for the joining process. The adjustment of the accumulator pressure occurs outside the joining processes. A differential cylinder is provided here as an actuator 20.

The hydraulic joining drive represents the linear movement on piston rod 21. As an alternative to the herein illustrated hydraulic actuator, an electromechanical drive with lifting spindle or a combination of both may also be provided.

Figure 2:
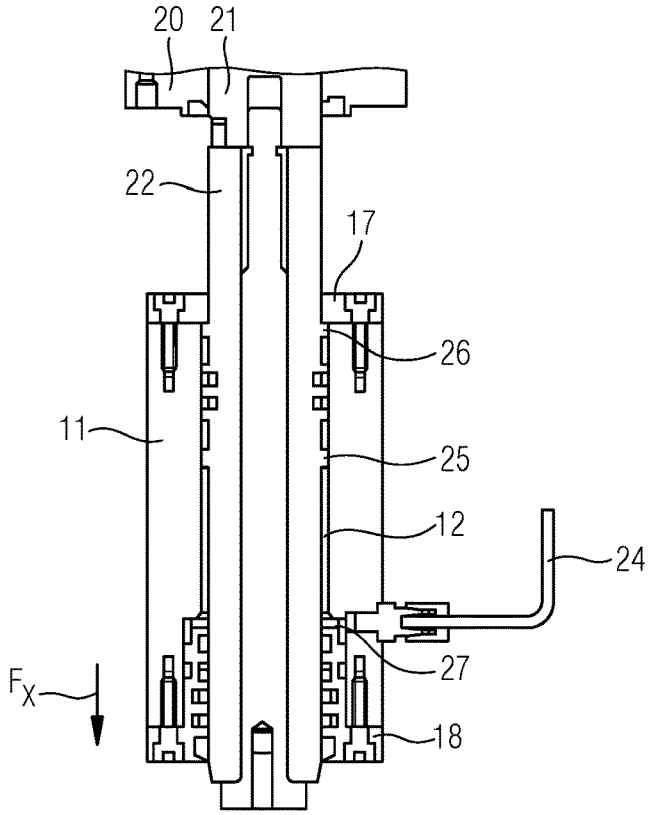
FIG. 2 illustrates the hold-down cylinder with a pressure chamber.

A punch 22, shown in FIG. 2, also known as a joining punch 22, is attached to piston rod 21. Hold-down cylinder 11 is designed as a ring cylinder 11. The active movement ("downwards") is limited by a flange 26 on joining punch 22. Likewise, the back movement of the hold-down device in the passive position is constraint by cylinder bottom 27 and flange 25. The hold-down force is generated by the pressure in pressure chamber 12, which is supplied via pressure connection 24.

A hold-down device 30 is attached on hold-down cylinder 11. In a downward movement of joining die 22, it initially impinges on a first metal sheet 32 as the first component 32, under which a second metal sheet 33 is arranged as the second component 33 to be joined. If joining punch 22 moves further toward the metal sheets 32 and 33 the pressure in pressure chamber 12 applies a force in the direction of metal sheets 32 and 33 onto hold-down cylinder 11 and hold-down device 30 attached thereto.

$$\text{Force}=\text{ring surface}*\text{pressure in pressure chamber}$$

$$\text{Ring surface}=(D_I^2*_{TT}/4)-(D_A^2*_{TT}/4)$$

$D_I$=inside diameter of the hold-down cylinder $D_A$=outside diameter of the joining die With hold-down device 30 mounted on the sheet metal, hollow rivet 31 is driven into sheet metals 32, 33 and establishes the joining connection. On the return stroke, joining punch 22 moves hold-down cylinder 11 again upward with flange 26.

Piston rod 21 of the rivet drive as joining drive 1 is driven by pressures $P_A$ and $P_B$ in pressure chambers 4, 5. The pressures are generated in hydraulic unit H with reference sign 3. Hydraulic unit 3 can be a throttle control with pressure generation and throttle valves, or a displacement control, in which a pump arrangement acts directly upon pressure chambers 4 and 5.

Sensor 55 measures position $S_A$ of piston rod 21 of rivet drive 2. Sensors 52 and 53 measure pressures $P_A$ and $P_B$ in pressure chambers 4, 5 of rivet drive 2. Sensor 51 measures temperature $T_A$ of the fluid in piston chamber 4. Additional pressure sensors and temperature sensors can detect additional conditions in the system. A CNC/PLC control unit that is not illustrated here collects the sensor signals and uses them for condition monitoring and to control the riveting process.

Hold-down cylinder 11 is arranged coaxially to joining punch 22 and moves with joining punch 22. The joining punch is attached to the active end of piston rod 21 and moves with piston rod 21. Thus, hold-down cylinder 11 also moves with piston rod 21. Pressure chamber 12 is supplied by pressure accumulator 13 with pressure $C_X$. Hold-down cylinder 11 will be located at the lower stop, retained by flange 26. Pressure $P_X$ and temperature $T_X$ in pressure chamber 12 are measured with sensors 54, 57. Position $S_X$ of hold-down cylinder 11 relative to joining punch 22 can be measured with sensor 56.

In one embodiment, pressure chamber 12 can be connected via valve $V_1$, reference sign 15, with line 7 to hydraulic unit 3. This first embodiment can be supplemented with a valve $V_3$, reference sign 6, which can separate pressure chamber/piston chamber 4 from hydraulic unit 3.

In another embodiment, pressure chamber 12 can be connected via valve $V_2$, reference sign 16 with line 8 to hydraulic unit 3. This second embodiment can correspondingly be supplemented with a valve $V_4$ (not shown in the sketch), wherein pressure chamber/annular chamber 5 can be separated from hydraulic unit 3 by means of the valve.

In a further embodiment, as shown in FIG. 1, both valves 15 and 16 may also be provided.

By means of measuring position $S_X$ of hold-down cylinder 11, it can be detected at which position of piston rod 21 the system meets metal sheets 32, 33. With the known geometry/position of metal sheets 32, 33 and piston rod 21, process monitoring can take place. Incorrect sheet metal thickness or wrong number of metal sheets can be detected as well as damage to hold-down down cylinder 11/hold-down device 10, die 34 or joining punch 22.

According to the invention, instead of position signal $S_X$, impingement of hold-down cylinder 11 on metal sheet 32 can also occur through observing pressure signal $P_X$. The impingement of hold-down cylinder 11 will result in a small but detectable pressure increase in pressure chamber 12 of the hold-down device.

Observation of pressure $P_X$ is advantageous compared to observation of pressure $P_A$, because the range of force of hold-down device 10 amounts to only 5 to 20% of the range of force of rivet drive/joining drive 2. Thus, sensor 54 has a higher resolution in the range of smaller forces compared to pressure sensor 52 of the piston chamber, which benefits the accuracy of the detection. For example, when measuring the sheet metal thickness indirectly using this method, it is desirable to be able to reliably detect possible small impact forces.

The method for adjusting pressure $P_X$ and for operating the hold-down device is briefly described below.

The method is described for the first of the above embodiments having a joining device 1 with valve 15. Valve 15 is activated so that pressure chambers 4 and 12 are connected. Hydraulic unit 3 is now controlled in such a way that the desired pressure is set in $P_A$ and $P_X$. For this setting, one of the pressure sensors 52, 54 can be used to measure pressure $P_A$ or $P_X$. During this process, the piston rod of the joining drive can move out if the $P_X$ pressure to be set is correspondingly large. After the desired pressure is reached, valve 15 is deactivated and the pressure chambers of piston chamber 4 and pressure chamber 12 are separated again. Set pressure $P_X$ in pressure chamber 12 of hold-down device 10 is held by accumulator 13. Hydraulic unit 3 can now be used to control the joining drive, while hold-down device 10 provides the desired hold-down force. Changes in $P_X$ pressure due to temperature fluctuations $T_X$ or leaks are disadvantageous. These can be detected during operation of the rivet drive by sensor 54 or 57.

In particular, as soon as a tolerance limit for $P_X$ is exceeded, the continuous riveting process can be paused and with the described method, pressure $P_X$ in accumulator 13 can be tracked back to the required value.

In some cases, movement of piston rod 21 during pressure adjustment may be detrimental and should be avoided. In such cases, by providing valve 6 piston chamber 4 may be separated from hydraulic unit 3, by bringing valve 6 into the closed position. Only then is valve 15 opened. Subsequently, the pressure in pressure chamber 12 is set by hydraulic unit 3 or the adjustment of the pressure in the pressure chamber 12 is concluded. After hydraulic unit 3 has set the pressure in accumulator 13/pressure chamber 12 and valve 15 has been closed, valve 6 can be opened again, in order to control the desired movement of piston rod 21 with hydraulic unit 3. Valve 6 is deactivated in the open position, wherein valve 15 is deactivated in the closed position. Thus, no active switching of either of these valves is required during the riveting operation.

The method described can also be applied in a second arrangement in which pressure chamber $P_X$ is not connected via valve 6 to piston chamber 4 but is connected via a valve 16 with annular chamber 5. If a movement of piston rod 21 is to be avoided during the pressure adjustment, an additional valve V4 can separate annular chamber 5 from hydraulic unit 3 and pressure chamber 12 during the pressure adjustment.

Figure 3:
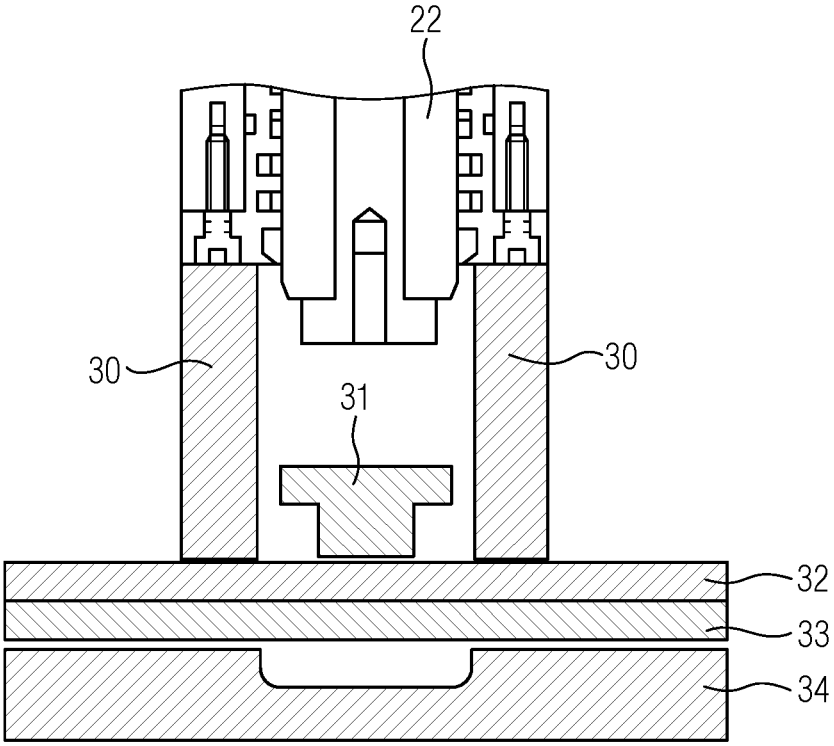
FIG. 3 illustrates the hold-down device with a hold-down cylinder.

Since the pressure chamber is limited by the punch together with the hold-down cylinder of the hold-down device, reference should have been correctly made to the hold-down unit. The hold-down unit consists of the hold-down device and punch 22. Depending on the axial longitudinal expansion of the punch, the hold-down device can also be arranged in the area of piston 21, deviating from the illustration shown, wherein then the axial length of hold-down device 30 is to be adjusted. See FIG. 3.

While this invention has been described with respect to at least one embodiment, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

COMPONENT IDENTIFICATION LISTING

1 Joining device=joining drive+hold-down device
2 Joining drive
3 Hydraulic unit
4 Piston chamber
5 Annular chamber
6 Valve piston chamber
7 Supply line piston chamber
8 Supply line annular chamber
10 Hold-down device
11 Hold-down cylinder
12 Pressure chamber
13 Pressure accumulator
14 Hydraulic supply line

15 Valve pressure accumulator—supply line piston chamber
16 Valve pressure accumulator—supply line annular chamber
17 1. Cover; cover on the joining drive side
18 2. Cover; cover on workpiece side
20 Cylinder of rivet drive, hydraulic actuator
21 Piston rod of rivet drive
22 Joining punch
24 Pressure connection, supply line pressure chamber
25 Flange on the joining punch
26 Flange on the joining punch
27 Cylinder bottom of hold-down cylinder
30 Hold-down device
31 Hollow rivet
32 First component
33 Second component
34 Die
51 Temperature sensor (piston chamber)
52 Pressure sensor $P_A$ (piston chamber)
53 Pressure sensor $P_B$ (annular chamber)
54 Pressure sensor $P_X$ (hold-down device)
55 Position sensor $S_A$ (piston rod)
56 Position sensor $S_X$ (hold-down device)
57 Temperature sensor $T_X$

What is claimed is:

1. A joining device to produce a punch/riveting connection, the joining device comprising:
- a joining drive, the joining drive including:
  - a hydraulic unit;
  - an axially movable piston rod; and
  - a hold-down device, the hold-down device including:
    - a hold-down cylinder, which is configured for moving axially in order to provide a hold-down force to a workpiece;
    - a pressure chamber to provide the hold-down force and/or a position of the hold-down device, the hold-down cylinder at least partially defining the pressure chamber, which is configured for at least partially holding a hydraulic fluid therein; and
    - a pressure accumulator, wherein the pressure chamber is continuously hydraulically connected to the pressure accumulator during a joining operation to produce the punch/riveting connection; and
- a differential cylinder with a piston chamber and an annular chamber to drive the axially movable piston rod, wherein the hydraulic unit includes a pump with reversible delivery direction, the pump being a 4-quadrant pump.

2. The joining device according to claim 1, wherein the piston chamber is connected to the hydraulic unit by way of a valve.

3. The joining device according to claim 1, wherein the pressure accumulator of the hold-down device is hydraulically connectable in a switchable manner by way of at least one valve with the hydraulic unit of the joining drive for the adjustment of a predetermined pressure in the pressure accumulator of the hold-down device.

4. The joining device of claim 1, wherein the hold-down cylinder is mounted to the axially movable piston rod, wherein the axially moveable piston rod and the hold-down cylinder limit the pressure chamber to provide the hold-down force.

5. The joining device according to claim 4, wherein the axially moveable piston rod has a radially protruding flange for providing a stop to limit an axial displacement of the hold-down cylinder.

6. The joining device according to claim 5, wherein the hold-down device has at least one cover that is detachably connected to the hold-down cylinder.

7. A method for operating a joining device to produce a punch/riveting connection, the method comprising the steps of:
- detecting a pressure in a pressure accumulator of the joining device or a pressure chamber of the joining device, the joining device including:
  - a joining drive, the joining drive including:
    - a hydraulic unit;
    - an axially movable piston rod; and
    - a hold-down device, the hold-down device including:
      - a hold-down cylinder, which is configured for moving axially in order to provide a hold-down force to a workpiece;
      - the pressure chamber to provide the hold-down force and/or a position of the hold-down device, the hold-down cylinder at least partially defining the pressure chamber, which is configured for at least partially holding a hydraulic fluid therein; and
      - the pressure accumulator, wherein the pressure chamber is continuously hydraulically connected to the pressure accumulator during a joining operation to produce the punch/riveting connection; and
  - a differential cylinder with a piston chamber and an annular chamber to drive the axially movable piston rod, wherein the hydraulic unit includes a pump with reversible delivery direction, the pump being a 4-quadrant pump;
- interrupting the joining operation dependent upon the pressure that is detected being a predetermined pressure;
- using the hydraulic unit of the joining drive for pressurization or pressure relief of the pressure chamber or the pressure accumulator for adjusting the predetermined pressure; and
- resuming the joining operation after adjusting the predetermined pressure.

8. The joining device of claim 1, further comprising a punch, wherein the pressure chamber is formed by the hold-down cylinder and the punch, wherein the pressure chamber is arranged radially between the hold-down cylinder and the punch.

* * * * *